US009420908B1

(12) United States Patent
White

(10) Patent No.: US 9,420,908 B1
(45) Date of Patent: Aug. 23, 2016

(54) NOVELTY DRINK INSULATING CONTAINER

(71) Applicant: Christopher M. White, Everett, MA (US)

(72) Inventor: Christopher M. White, Everett, MA (US)

( * ) Notice: Subject to any disclaimer, the term of this patent is extended or adjusted under 35 U.S.C. 154(b) by 123 days.

(21) Appl. No.: 13/838,861

(22) Filed: Mar. 15, 2013

(51) Int. Cl.
*F21V 33/00* (2006.01)
*A47G 19/22* (2006.01)

(52) U.S. Cl.
CPC ..... *A47G 19/2288* (2013.01)

(58) Field of Classification Search
CPC ..... B65D 25/20; B65D 81/3879; B65D 81/3876; A45F 3/16; F25D 31/007; F25D 2331/803; F25D 2331/805; F25D 2331/801
USPC ..... 362/101, 96, 154, 155, 156; 220/739, 220/903; 224/148.4, 148.5, 148.6, 148.7; 383/97
See application file for complete search history.

(56) References Cited

U.S. PATENT DOCUMENTS 4,197,890 A * 4/1980 Simko ..... 383/97
4,390,928 A * 6/1983 Runge ..... 362/101
4,513,895 A * 4/1985 Leslie ..... 224/153
4,871,597 A * 10/1989 Hobson ..... 428/36.1
4,886,183 A * 12/1989 Fleming ..... 220/739
5,186,350 A * 2/1993 McBride ..... 220/739
5,211,699 A * 5/1993 Tipton ..... 362/101
5,651,523 A 7/1997 Bridges
6,092,905 A * 7/2000 Koehn ..... 362/101
6,913,159 B1 * 7/2005 Goldberg ..... B65D 23/106 215/395
D676,717 S * 2/2013 Ceder ..... D7/624.2
8,459,821 B1 * 6/2013 Fusilier ..... 362/101
2001/0032867 A1 * 10/2001 Silbert ..... 224/148.5
2003/0228072 A1 * 12/2003 Tyberg ..... 383/2
2003/0230511 A1 * 12/2003 Meza ..... 206/545
2004/0233661 A1 * 11/2004 Taylor ..... 362/101
2005/0137064 A1 * 6/2005 Nothnagle ..... A63B 21/0726 482/108
2005/0224448 A1 * 10/2005 Sutton ..... 215/386
2006/0186129 A1 8/2006 Allnut et al.
2006/0219858 A1 10/2006 Iacovino
2007/0017924 A1 * 1/2007 Hundley ..... 220/737
2007/0205176 A1 * 9/2007 Karp ..... A45D 33/26 215/237
2008/0169688 A1 * 7/2008 Funderburg ..... 297/188.06
2009/0080180 A1 * 3/2009 Bertken ..... 362/101
2014/0131372 A1 * 5/2014 Hiner ..... 220/739

* cited by examiner

*Primary Examiner* — Anh Mai
*Assistant Examiner* — Glenn Zimmerman
(74) *Attorney, Agent, or Firm* — Robert C. Montgomery; Montgomery Patent & Design

(57) ABSTRACT

An insulated drink holder with various attachments that aid in personal survival. The drink holder is dimensioned to receive a beverage within its interior. The drink holder includes a handle, a light, and a compass. It further includes a removable, mirrored storage cap for retaining small items and which has a magnet. If the drink holder receives a bottle it can have a zipper to selectively tightened the holder on the bottle. The drink holder includes a battery to power the light and a switch to selectively apply power.

16 Claims, 6 Drawing Sheets

NOVELTY DRINK INSULATING CONTAINER

RELATED APPLICATIONS

There are currently no applications co-pending with the present application.

FIELD OF THE INVENTION

The presently disclosed subject matter is directed towards picnic coolers. More particularly, the present invention relates to picnic coolers having multiple thermally insulated compartments and storage compartments.

BACKGROUND OF THE INVENTION

Insulated beverage containers, or "koozies" as they are commonly known, are used to help keep canned beverages cool. They work by insulating the can from outdoor temperatures and a user's hands, which tend to warm such beverages, while protecting the user's hands from the cold.

Koozies are available in a wide variety of colors and styles which help distinguish one koozie from another. Some are adorned with shoulder straps, advertising, and small pockets to help increase their versatility while also making one koozie more useful than another. As such, manufacturers are on lookout for innovations that can be incorporated into a koozie to increase their appeal and usefulness.

Some of the most useful devices relate to survival. When lost or away from civilization a compass is an extremely useful device. Other useful devices include mirrors, waterproof matches, thread, needles, fish hooks, fishing line, and lights. At times such devices can be very useful. For example, a laced string can be useful to hold items while a magnet can be useful to determine whether an item is made of a ferrous material (for example, iron and steel). Unfortunately, such items are rarely available when needed in an emergency.

Accordingly, there exists a need for a means by which the common koozie can be modified to be more useful in a manner that has broad appeal. Such a koozie should still be useful for keeping a retained beverage cold, but should make available items that are useful in an emergency.

SUMMARY OF THE INVENTION

The principles of the present invention provide for drink holders that are useful for keeping a retained beverage cold, but that also makes items that are useful in an emergency available.

A drink holder according to the present invention incorporates a tubular-shaped insulated receiver body having an exterior, an interior, a bottom, and a neck having a top opening and a zipper. The receiver body is dimensioned to receive a bottle such that the zipper can expand or tighten the top opening to better retain the bottle. An accessory piece is attached to the zipper, while the exterior includes a handle. At the bottom is a removable storage cap that is dimensioned to retain various small items.

The drink holder further includes a light-emitting diode for providing illumination, a battery, preferably a button-cell battery, and a switch for selectively applying power to the light-emitting diode. The accessory piece can include a spring-actuated carabiner, a compass, and/or a bottle opener. The storage cap has a mirrored surface and a magnet.

An alternative drink holder has a receiver body with a cylindrical wall having an exterior and an interior, a bottom, and a top opening. That receiver body and top opening are dimensioned to receive and retain a can. There is a handle on the exterior and a removable storage cap that is selectively attached to the bottom for retaining small items.

That drink holder further includes a light-emitting diode for providing illumination, a battery for supplying power, and a switch for selectively applying power to the light-emitting diode. A compass is attached to the exterior, and the storage cap includes a mirrored surface and a magnet.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
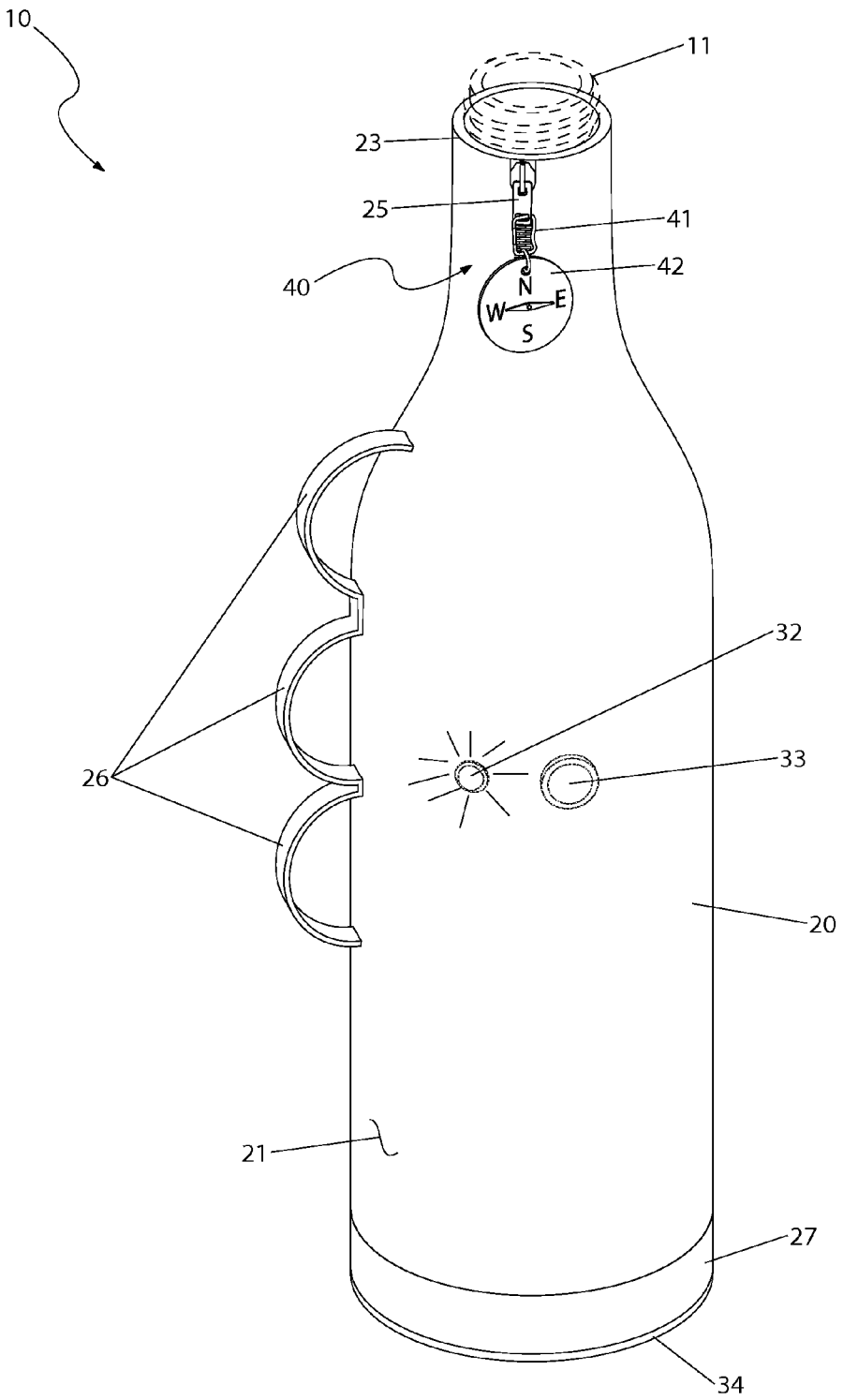
FIG. 1 is an environmental view of a drink insulating receiver 10 that is in accord with the principles of the present invention.

10 drink holder
11 bottle
12 can
20 receiver body
21 exterior
22 interior
23 top opening
24 zipper
25 zipper pull
26 handle
27 bottom
28*a* first threaded portion
28*b* second threaded portion
29 battery clip
30 battery
31 electrical wiring
32 light-emitting diode
33 pushbutton
34 storage cap
35 mirror
36 magnet
40 accessory piece
41 clip
42 compass
43 bottle opener
50 drink insulating receiver
51 receiver body
52 exterior
53 interior
54 handle
55 bottom

56 storage cap
57 compass

DETAILED DESCRIPTION OF THE PREFERRED EMBODIMENT

Figure 3:
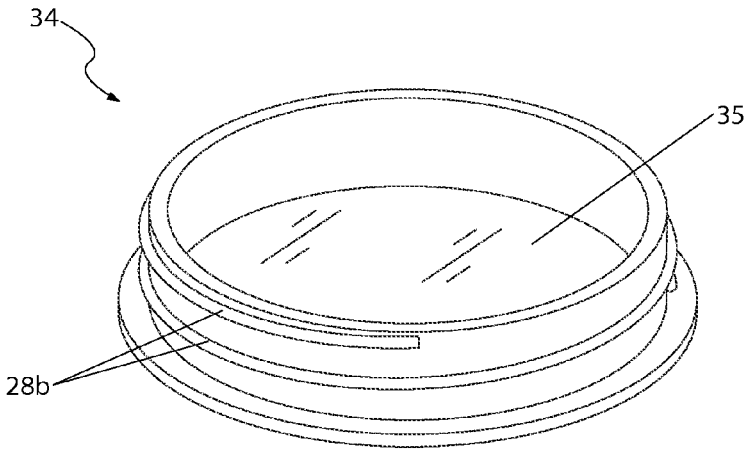
FIG. 3 is a perspective view of the storage cap 34 shown in FIG. 2.
Figure 4:
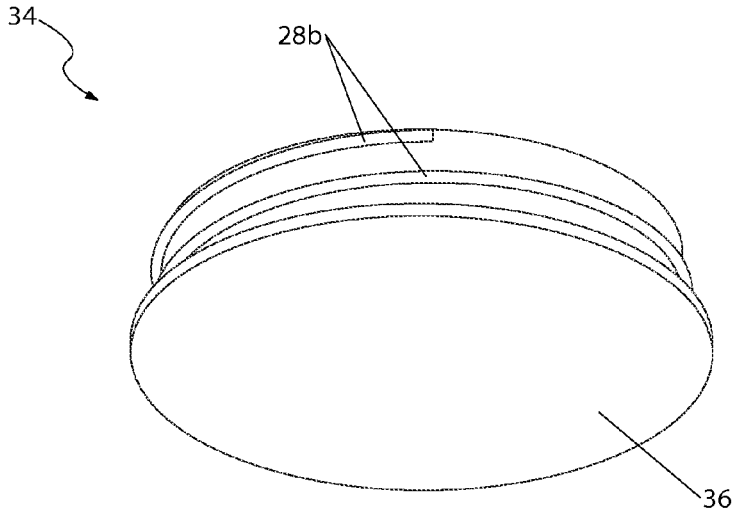
FIG. 4 is an opposing perspective view of the storage cap 34 of FIG. 2 and FIG. 3.
Figure 5:
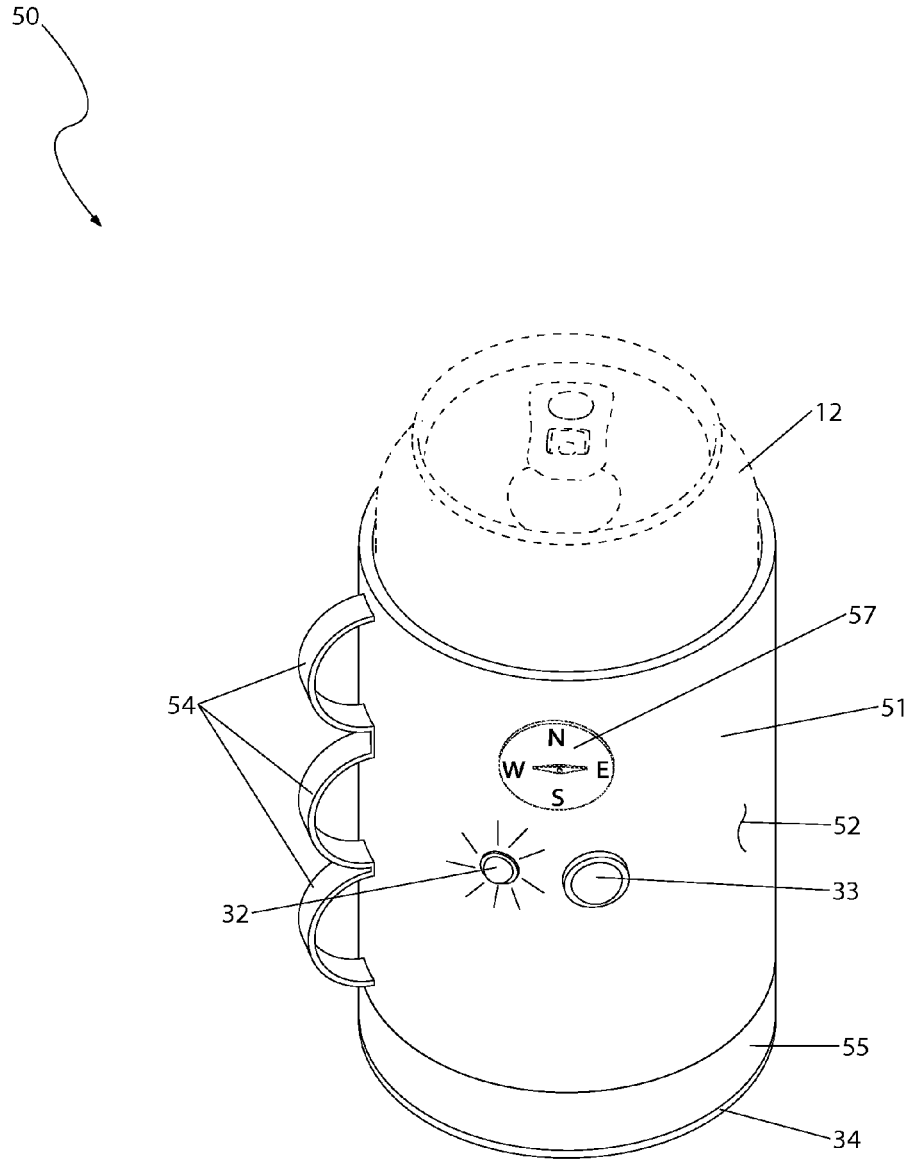
FIG. 5 is an environmental view of an alternate drink insulating receiver 50 that is in accord with the principles of the present invention.
Figure 6:
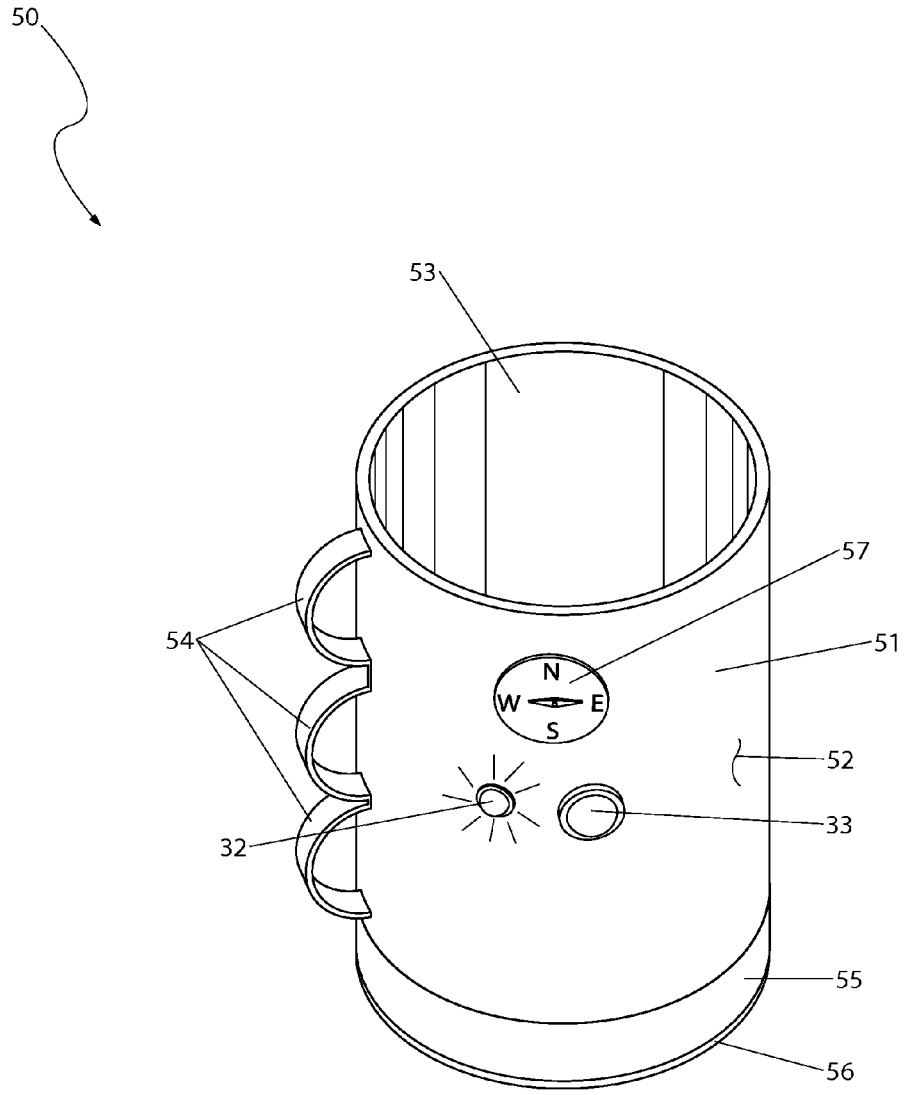
FIG. 6 is a perspective view of the drink insulating receiver 50 shown in FIG. 5; and, FIG. 7 is another perspective view of the drink insulating receiver 50 shown in FIG. 5 and FIG. 6.
Figure 7:
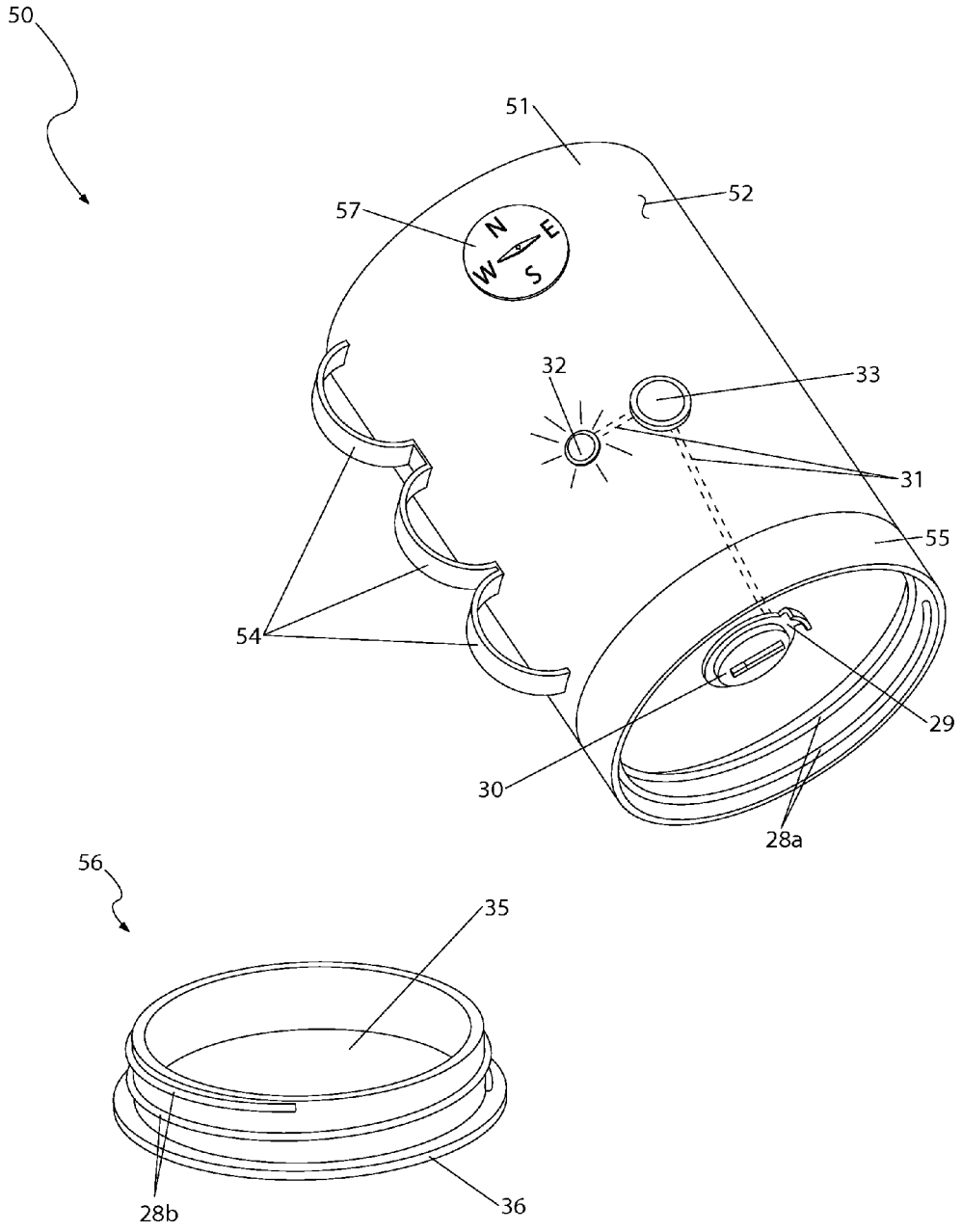

The best mode for carrying out the invention is presented in terms of its preferred embodiment, FIGS. 1 through 4 and the rest depicted in FIGS. 5 through 7, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The principles of the present invention provide for novelty drink insulating receivers which help maintain the temperature of a beverage while also making available to the user items that are highly useful for personal survival. Such drink insulating receivers also protects a user's hands from temperatures associated with a beverage container, which is preferably a bottle, yet other containers such as cans can also benefit.

FIG. 1 presents an environmental view of a first embodiment drink holder 10 that is in accord with the present invention. The drink holder 10 has an insulated receiver body 20 that has a tubular-shape and a narrow neck that are dimensioned to encompass a common beverage bottle 11. The receiver body 20 is slightly larger than the bottle 11 to enable placement of the bottle inside the receiver body 20. The second embodiment has an alternate receiver body 51 that holds cans 12 (see FIG. 5) as is described subsequently.

The receiver body 20 encompasses the bottle 11 to help maintain its temperature and to protect the user's hand during holding. The receiver body 20 includes a top opening 23 which assists placement or removal of the bottle 11 in its interior 22 (see FIG. 2) of the receiver body 20. The receiver body 20 is preferably fabricated from materials such as, but not limited to: foam, neoprene, or the like, and may be fabricated in various colors, patterns, or the like to accommodate the user.

Figure 2:
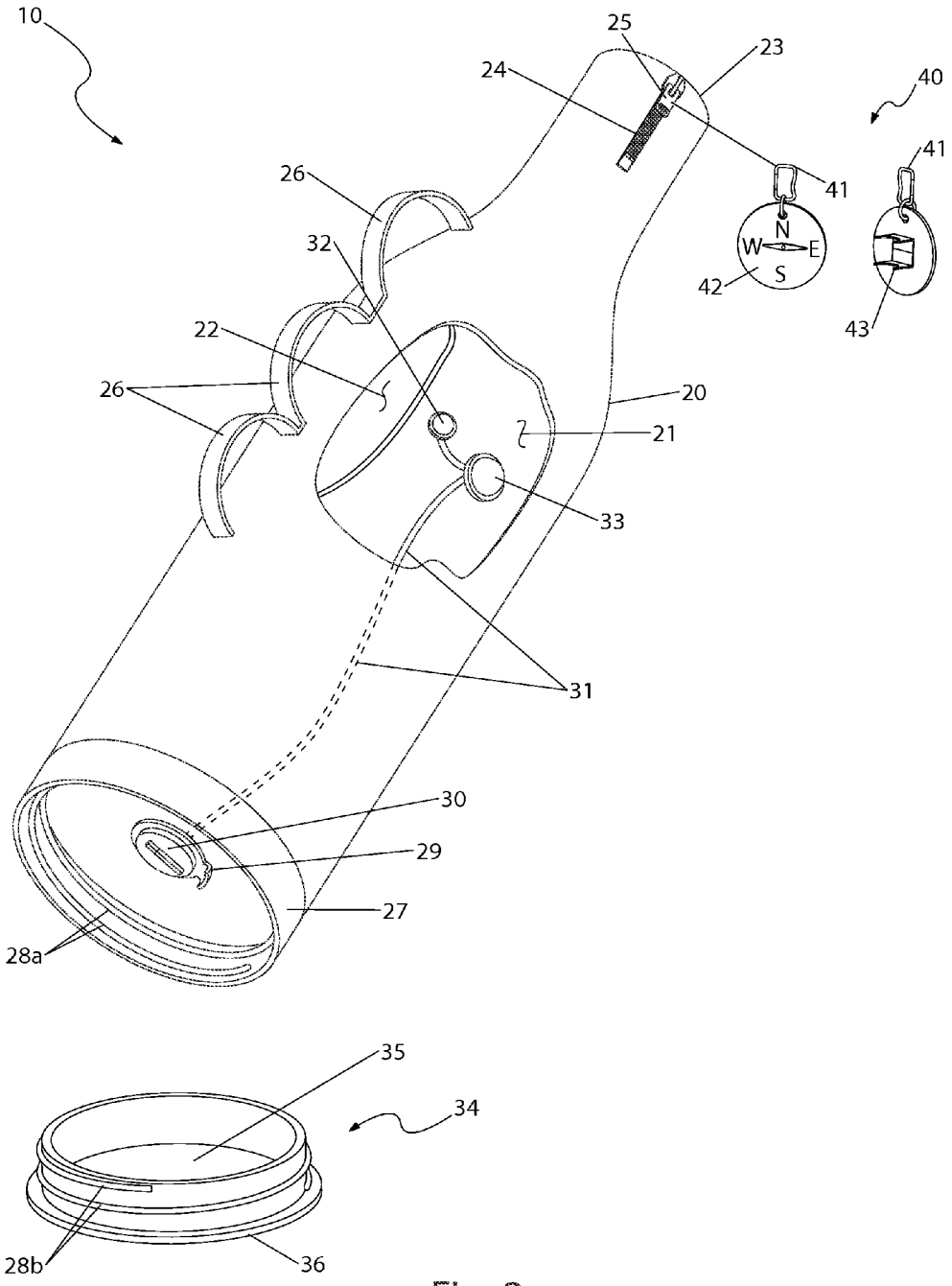
FIG. 2 is a perspective, partial cut-away view of the drink insulating receiver 10 shown in FIG. 1 depicting an accessory piece 40 and a storage cap 34.

Referring now to FIG. 1 and FIG. 2, the exterior 21 of the drink holder 10 incorporates features and attachments for personal necessity. At the top of the receiver body 20 is a zipper 24 which is used to expand or tighten the top opening 23 for placement or removal of the bottle 11. The zipper 24 has a zipper pull 25 which suspends an accessory piece 4. The exterior 21 also includes a handle 26 and a light-emitting diode 32. The receiver body 20 has a bottom 27.

FIG. 2 shows a removed accessory piece 40 and a removed storage cap 34, while FIGS. 3 and 4 provide opposing perspective views of the storage cap 34. Referring to those figures, as noted the zipper pull 25 suspends the removable attachable accessory piece 40. The accessory piece 40 includes a clip 41, a compass 42, and a bottle opener 43. The clip 41 is preferably a common spring-actuated carabiner. However, other spring devices may be utilized instead. The clip 41 is attached to a disc-shaped body which includes the compass 42 on one (1) side surface and the bottle opener 43 on the other. The compass 42 is a common navigating instrument for determining direction while the bottle opener 43 is a common device which removes bottle caps.

As shown in FIG. 1 and FIG. 2, the exterior 21 includes the handle 26, which is used to provide a secure gripping feature. The handle 26 is beneficially attached to the exterior 21 via sewing techniques, yet other attachment means may be utilized. The handle 26 is depicted as comprising a multiple-looped configuration for illustration only as other configurations may be used.

Adjacent the handle 26 is the light-emitting diode 32. The light emitting diode 32 is used to provide illumination. The light-emitting diode 32 is activated by a common momentary pushbutton 33 that is located next to the light-emitting diode 32. Power for the light-emitting diode 32 is supplied via a battery 30 that is located on the bottom of the receiver body 20. Electrical wiring 31 that runs within the receiver body 20 is used to interconnect the light-emitting diode 32 and the pushbutton 33 to the battery 30. The battery 30 is preferably a common button-cell battery accessed by removing a storage cap 34 from the bottom 27. A common battery clip 29 mounted to the bottom 27 is used to retain the battery 30 in place. The bottom 27 is beneficially fabricated from a durable plastic material which supports removal and attachment of a storage cap 34.

The inner surface of the bottom 27 has a first threaded portion **28*a* which threads with a second threaded portion 28*b* of the storage cap 34. The storage cap 34 comprises a waterproof cup-shaped body which is also fabricated from a durable plastic. The storage cap 34 is dimensioned to retain desired items such as, but not limited to: matches, fishing line, fishing hooks, or the like. The interior surface of the storage cap 34 forms a mirror 35 having reflective characteristic suitable for starting fires or gaining the attention of others. The bottom exterior of the storage cap 34 forms a magnet 36 which enables the drink holder 10 to magnetically attach to a desired surface such as a boat or vehicle to hold the drink holder 10** upright.

FIG. 5 shows an environmental view of an alternative drink insulating receiver 50 that is in accord with the principles of the present invention. The drink insulating receiver 50 retains and thermally insulates a can 12. The drink insulating receiver 50 includes a tubular-shaped open-topped receiver body 51 which enables insertion or removal of a can 12 into and out of an interior 53 (see FIG. 6). The drink insulating receiver 50 is fabricated from similar materials as the abovementioned receiver body 20.

Referring now to FIG. 6 and FIG. 7 the drink insulating receiver 50 includes a storage cap 56 and a handle 54 on the exterior 52 of the drink insulating receiver 50 to provide a grasping means. The handle 54 is attached to the exterior 52 by common sewing techniques and beneficially comprised a multi-looped configuration. The exterior 52 also retains a compass 57 that is beneficially fixed to the receiver body 51 via integral molding techniques. The compass 57 differs from the compass 42 by the way it is attached.

The exterior 52 also retains a light-emitting diode 32 and a pushbutton 33 for providing illumination. The light-emitting diode 32 and the pushbutton 33 are electrically interconnected via electrical wiring 31 to the battery clip 29 and battery 30 which are located upon a bottom 55. The bottom 55 is beneficially fabricated from a durable plastic and includes a first threaded portion **28*a* that mates with a second threaded portion 28*b* of a storage cap 56. The storage cap 56 and the bottom 55 provide a waterproof storage space for desired items (matches, for example). The interior surface of the storage cap 56 forms a mirror 35 while the out surface forms a magnet 36**.

It is envisioned that other styles and configurations of the present invention can be easily incorporated into the teachings of the present invention, and while only two particular configurations are shown and described, that is only for purposes of clarity and disclosure and not by way of limitation of scope.

The preferred embodiment of the present invention can be used by the common user in a simple and effortless manner with little or no training. After initial purchase or acquisition of the drink holder 10, it would be used as indicated in FIG. 1 to retain a bottle 11.

The method of installing and utilizing the drink holder 10 may be achieved by performing the following steps: acquiring the drink holder 10; unzipping the zipper 24 by downwardly pulling the zipper pull 25; inserting a bottle 11 into the interior 22 of the receiver body 20; zipping the zipper 24; grasping the handle 26 to drink from the bottle 11; removing the accessory piece 40 by the clip 41 to use the compass 42 or bottle opener 43 as desired; depressing the pushbutton 33 to illuminate the light-emitting diode 32; disengaging the storage cap 34 from the bottom 27 to store desired items within or use the mirror 35; attaching the storage cap 34 onto the bottom 27 to utilize the magnet 36; removing the bottle 11 from the receiver body 20 as desired; and, enjoying a beverage while being able to deal with survival type situations as needed.

The alternate embodiment of the present invention can be utilized by the common user in a simple and effortless manner with little or no training. After initial purchase or acquisition of the novelty drink insulating receiver 50, it would be installed as indicated in FIG. 5.

The method of installing and utilizing the drink insulating receiver 50 may be achieved by performing the following steps: acquiring the drink insulating receiver 50; inserting a can 12 into the interior 53 of the receiver body 51; grasping the handle 54 to drink from the can 12; using the compass as desired; depressing the pushbutton 33 to illuminate the light-emitting diode 32; disengaging the storage cap 56 from the bottom 55 to store desired items within or uses the mirror 35; attaching the storage cap 56 onto the bottom 55 to use the magnet 36; removing the can 12 from the receiver body 51 as desired; and enjoying a beverage while being able to deal with survival type situations.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A drink holder, comprising:

a tubular-shaped insulated receiver body having an exterior, an interior, a threaded bottom, and a neck with top opening and a zipper, wherein said receiver body is dimensioned to receive a bottle such that said zipper can expand or tighten said top opening;

an accessory piece attached to said zipper;

a handle affixed to said exterior, wherein said handle comprises a multi-looped finger grip; and, a removable storage cap selectively threaded to said bottom, wherein said storage cap is dimensioned to retain items and wherein said storage cap comprises an interior surface comprising a light reflective mirror visually accessible when said storage cap is removed from said bottom.

2. The drink holder according to claim 1, further including a light-emitting diode on said exterior, wherein said light-emitting diode is for providing illumination.

3. The drink holder according to claim 1, wherein said accessory piece includes a spring-actuated carabiner.

4. The drink holder according to claim 1, wherein said accessory piece includes a compass.

5. The drink holder according to claim 1, wherein said accessory piece includes a bottle opener.

6. The drink holder according to claim 2, further including a switch on said receiver body for selectively applying power to said light-emitting diode.

7. The drink holder according to claim 6, further including a battery attached to said bottom and which is operatively connected to said switch and to said light-emitting diode.

8. The drink holder according to claim 7, wherein said battery is a button-cell battery accessed by unthreading said storage cap.

9. The drink holder according to claim 7, wherein said storage cap includes a magnet.

10. A drink holder, comprising:

a cylindrical insulated receiver body having a cylindrical wall with an exterior and an interior, a threaded bottom, and a top opening, wherein said receiver body and said top opening are dimensioned to receive and retain a can;

a handle affixed to said exterior, wherein said handle comprises a multi-looped finger grip; and, a removable storage cap selectively threaded onto said bottom, wherein said storage cap is dimensioned to retain items and wherein said storage cap comprises an interior surface comprising a light reflective mirror visually accessible when said storage cap is removed from said bottom.

11. The drink holder according to claim 10, further including a battery attached to said bottom, and a light-emitting diode on said exterior, wherein said light-emitting diode is for providing illumination.

12. The drink holder according to claim 10, further including compass attached to said exterior.

13. The drink holder according to claim 10, wherein said storage cap has a magnet.

14. The drink holder according to claim 11, further including a switch on said receiver body for selectively applying power to said light-emitting diode.

15. The drink holder according to claim 14, wherein said battery is operatively connected to said switch and to said light-emitting diode.

16. The drink holder according to claim 15, wherein said battery is a button-cell battery accessed by removing said storage cap.

* * * * *